United States Patent [19]

Heubeck

[11] 3,968,990

[45] July 13, 1976

[54] DENTAL PATIENT'S CHAIR INCLUDING PADDED BACKREST

[75] Inventor: Erich Heubeck, Bensheim/Zell, Germany

[73] Assignee: Siemens Aktiengesellschaft, Erlangen, Germany

[22] Filed: Aug. 7, 1974

[21] Appl. No.: 496,015

[30] Foreign Application Priority Data

Aug. 10, 1973 Germany ..... 2340605

[52] U.S. Cl. ..... 297/452; 297/460

[51] Int. Cl.[2] ..... A47C 7/02

[58] Field of Search ..... 297/452, 455, 456, 216, 297/460, 390, DIG. 1, DIG. 2

[56] References Cited

UNITED STATES PATENTS

| | | | |
|---|---|---|---|
| 2,144,233 | 1/1939 | Stewart | 297/216 X |
| 2,491,784 | 12/1949 | Thompson | 297/460 X |
| 3,154,345 | 10/1964 | Lambrecht | 297/452 X |
| 3,323,835 | 6/1967 | Barecki | 297/460 X |
| 3,627,379 | 12/1971 | Faust | 297/216 |
| 3,669,498 | 6/1972 | Meyers | 297/452 |
| 3,695,707 | 10/1972 | Barecki et al. | 297/460 |
| 3,841,704 | 10/1974 | Platner et al. | 297/DIG. 2 |

FOREIGN PATENTS OR APPLICATIONS

| | | | |
|---|---|---|---|
| 559,558 | 8/1957 | Belgium | 297/460 |

*Primary Examiner*—James T. McCall
*Assistant Examiner*—Darrell Marquette
*Attorney, Agent, or Firm*—Haseltine, Lake & Waters

[57] ABSTRACT

A dental patient's chair wherein a padding-supporting portion includes a rigid carrier or support frame having fastened to the side remote from the padding cover a unitary shaped element covering the rearwardly facing surface of the backrest, which is elastically-shaped in planes perpendicular to the plane of the backrest, and which is exteriorly provided with a washable surface.

3 Claims, 2 Drawing Figures

DENTAL PATIENT'S CHAIR INCLUDING PADDED BACKREST

FIELD OF THE INVENTION

The present invention relates to a dental patient's chair and, more particularly, a chair having a padded backrest.

DISCUSSION OF THE PRIOR ART

In German patent application No. P 21 295 60.3 there is described a dental patient's chair in which the backrest is provided at its front face with a padding cover which is operative so as to be, meaning without the assistance of any tool, detachable and removable from its fastening or support. The padding cover supporting portion, with the backrest rear side is herein constituted of a plastic material shell. During the treatment of patients in fully reclining positons, in effect, with an almost horizontally supported patient and seated treating personnel, the dentist and his assistant have extremely limited freedom of knee movement since, in this position of the chair, the rear side of the backrest lies practically immediately above the thighs of the seated treating person and, respectively, his assistant. In particular, in this position of treatment, the relatively hard rearward portion of the backrest has been found to be disadvantageous. Accordingly, it has been attempted to shape the rear side of the backrest so as to be softer.

In another prior art dental patient's chair, the rear side of the back rest is padded to this effect. The padding is formed in that, on the rear side of the frame of the backrest, one or more foam material elements are glued in laminate relationship dependent upon the thickness of the desired padding. Over this padding base there is then drawn a bag-like cover portion of synthetic leather, leatherette, or the like, which has previously been sewn, glued or brazed together in accordance with the contour of the seat. The application of the padding is thus relatively difficult, time consuming and expensive and, moreover, can only be made by manual labor. Additionally, in view of the relatively flat surfaces along the rear side, imprecisions in shape become particularly noticeable. A good degree of conformance of the padding with the rear side of the backrest is attainable only with relatively great difficulty.

SUMMARY OF THE INVENTION

Accordingly, it is an object of the invention to provide an improved and novel dental patient's chair wherein a padding-supporting portion includes a rigid carrier or support frame having fastened to the side remote from the padding cover a unitary shaped element covering the rearwardly facing surface of the backrest, which is elastically-shaped in planes perpendicular to the plane of the backrest, and which is exteriorly provided with a washable surface. Essentially, the invention provides for a simply manufactured construction of the chair backrest. In particular, there is attained a simple and inexpensive padding of the rear side of the backrest. Concurrently, there are achieved the requirements of providing a good degree of conformance in shape.

BRIEF DESCRIPTION OF THE DRAWING

An advantageous embodiment of the invention is now described in the following detailed descripiton of the invention, taken in conjunction with the accompanying drawing; in which.

DETAILED DESCRIPTION

Figures 1, 2:
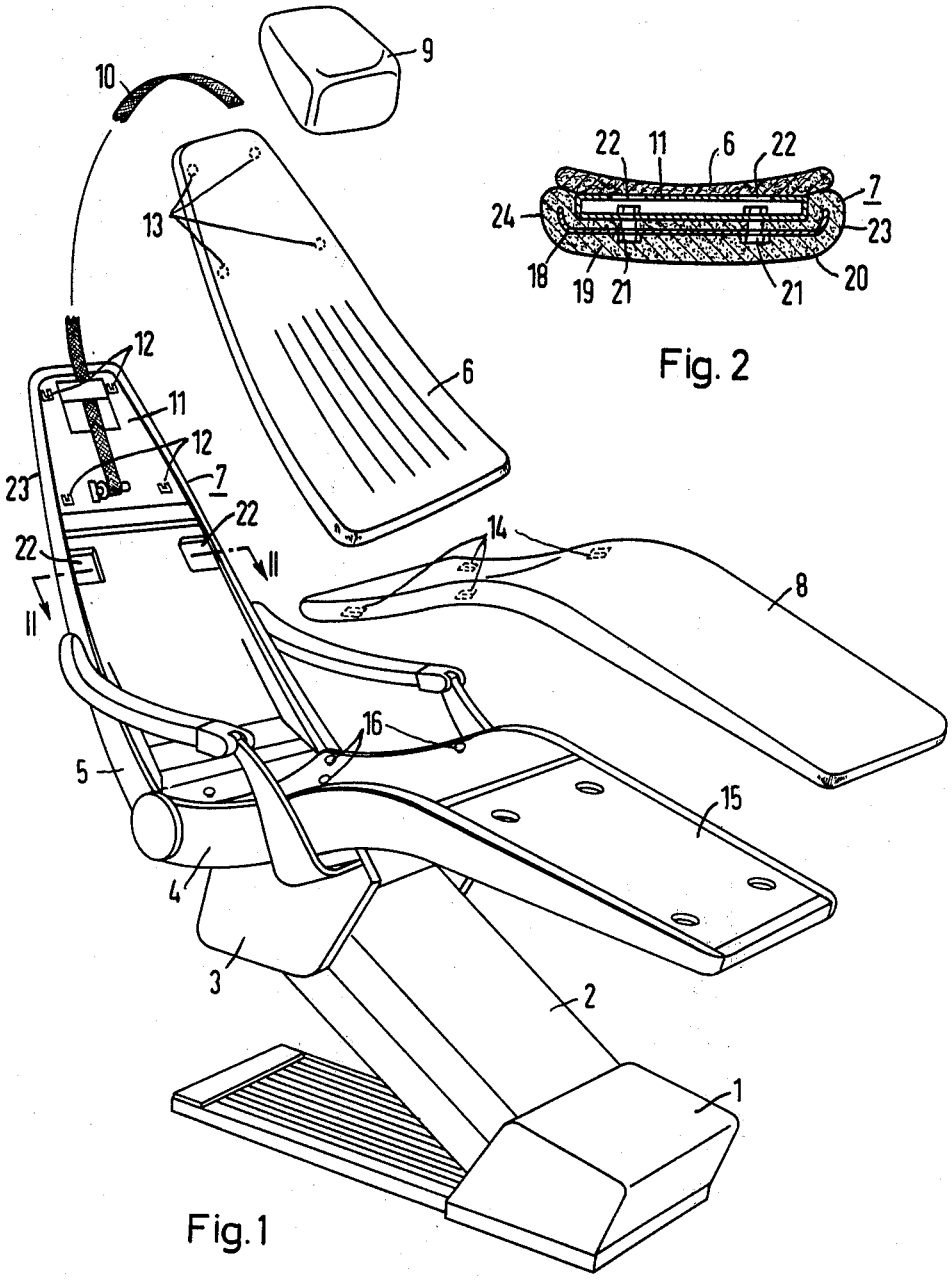
FIG. 1 is an exploded perspective view of a dental patient's chair constructed pursuant to the present invention.
FIG. 2 is a sectional view, on an enlarged scale, taken along line 2—2 in FIG. 1.

Referring now in detail to the drawing, FIG. 1 illustrates a dental patient's chair comprising a chair pedestal 1, a parallelogram-type support arm 2 which is linkedly connected to the pedestal 1, a carrier portion 3 for a seat 4, and a backrest 5. The backrest 5 is provided along its front side, in effect, in its reclining or support region, with a relatively thin-walled padded mat 6, and along its rear side with an elastic formed portion 7. The seat similarly contains a padded mat, which is designated in the drawing by reference numeral 8. In the assembled condition, a head pad 9 is loosely positioned on the padded mat 6 in the area of head support, and is retained by means of a lengthwise adjustable strap 10. The nucleus of the backrest 5 is formed by a sheet metal frame 11, which has fastened to the head-supporting area thereof four double-U-shaped slide rails 12, in which are slidable complimentary elements or fastener means 13 located in padded mat 6. For fastening of the padded mat 8 for the seat 4, the fastener means are reversely positioned. To this effect, slide rails 17 are fastened to padded mat 8, and the complimentary elements or fastening means 16 to the seat frame 15. The elements or fastener means 13 and 16 are specially shaped screws, which are introduced by their heads in the slide rails. The slie rails 12, 17 provide an adequate clamping effect in view of their configurations so as to prevent any inadvertent detachment of the padded mats 6 and 8.

FIG. 2 illustrates a transverse section of the backrest 5 along line 2—2 in FIG. 1, and shows the construction of the backrest, and particularly the rear side formed portion 7. The nucleus of the back rest 5 is formed by the sheetmetal frame 11. The shaped portion 7 essentially is constructed by means of a profiled support element 18 serving as a stiffener, which is constructed of wood fibers compressed with resin, about which there is foamed an elastic foam material and which forms the foam material member 19. The surface of the foam material member 19 is encompassed by a foil or sheeting 20. The foil 20 also encompasses the foam material member 19 along its sides (side walls 23,24) so that, viewed from externally thereof, the entire backrest padding consists of only two parts, namely, the padded mat 6 and the shaped portion 7. The shaped portion 7 is constructed in an operative process, in which the support element 18 and a plastic material foil or sheeting 20 are positioned in a shell-like form which conforms to the contour of the backrest, and in which the hollow spaces are then foam-filled with the foam material. The foil, in that case, is positioned along the interior surface of the form. The thus constructed formed or shaped portion 7 is then screwed by means of screws 21, which are anchored in the support element 18, to the sheet metal frame 11. Accessibility to the fastening means is afforded through the provision of apertures 22.

The utilized foam material is formably elastic at least in planes extending in perpendicular to the plane of the backrest. The foil 20 is similarly elastic and, moreover, washable.

As the support material there may also be utilized a plastic material component which is produced in a vacuum deep-drawing process. Also a deep-drawn sheet metal element, or a fiberglass-reinforced element, or the like may be employed. The support element 18 need not be foam covered on both sides thereof. Depending upon circumstances, it may be sufficient that only the side of the support element 18 opposite to the padded mat 6 be foam-covered with the foam material. Due to the foaming, an extremely good degree of conformance to form may be obtained by the rearward padding of the backrest.

While there has been shown what is considered to be the preferred embodiment of the invention, it will be obvious that modifications may be made which come within the scope of the disclosure of the specification.

What is claimed is:

1. In a dental patient's chair including a seat and a backrest forming an upper patient-supporting surface; and a padding cover being supported on the upper patient-supporting surface of said backrest, the improvement comprising; said upper patient-supporting backrest including a generally flat, plate-like rigid support frame extending over essentially the major surface area of said backrest and having upstanding side walls extending along the edges thereof; means for detachably fastening said padding cover to said support frame; a shaped element being fastened to said support frame on the side of said frame opposite to that supporting said padding cover; and a rigid form-defining support element being embedded in said shaped element, said shaped element being a shell-like shaped component encompassing the rear surface and having portions cupping the side walls of said support frame, said shaped element being resiliently elastic in planes extending perpendicular to the plane of said backrest and having an exterior washable surface, said padding cover covering the entire front surface of said backrest and extending out so as to contact the portions of the shaped element cupping the upstanding side walls of said support frame whereby the frame is covered in its entirety.

2. A chair as claimed in claim 1, said shaped element comprising an elastic foam material member; and a plastic material foil covering the exterior surface of said shaped element.

3. A chair as claimed in claim 1, said support element being constituted of compressed wood fibers and binder means.

* * * * *